United States Patent [19]

Osip et al.

[11] Patent Number: 4,993,569

[45] Date of Patent: Feb. 19, 1991

[54] PIERCING CLOSURE

[75] Inventors: Thomas W. Osip, Worthington, Ohio; Jerold W. Montgomery, Libertyville, Ill.; Paul A. Pezzoli, Worthington, Ohio

[73] Assignee: Abbott Laboratories, Abbott Park, Ill.

[21] Appl. No.: 388,887

[22] Filed: Aug. 3, 1989

[51] Int. Cl.[5] ..... B65D 41/00

[52] U.S. Cl. ..... 215/226; 215/250; 222/83

[58] Field of Search ..... 215/226, 250; 222/83, 222/81

[56] References Cited

U.S. PATENT DOCUMENTS 4,770,305 9/1988 Su ..... 215/250

4,795,043 1/1989 Odet et al. ..... 222/83 X

*Primary Examiner*—Stephen Marcus

*Assistant Examiner*—Nova Stucker

*Attorney, Agent, or Firm*—D. O. Nickey; L. R. Drayer; E. H. Gorman, Jr.

[57] ABSTRACT

This invention is concerned with a closure which permits the sterile opening of a membrane sealed container in a single-action motion which also maintains a hermetic seal under retort conditions. This closure includes a generally cylindrical side wall having threads along the inner surface thereof, a top with an upper surface having a protective rim extending upwardly therefrom, with the top also having a dome assembly with the protective rim extending above such dome assembly. The dome has a top and bottom surface, with at least one plow member projecting downwardly from the bottom surface of the dome.

20 Claims, 4 Drawing Sheets

PIERCING CLOSURE

TECHNICAL FIELD

The present invention relates generally to a closure for a container, and more particularly, to a plastic closure which permits the sterile opening of a hermetic membrane seal in a single action motion.

BACKGROUND ART

To ensure proper nutritional support for newborn infants, many doctors and hospitals recommend the use of liquid pediatric nutritional products. Pediatric nutritional products are utilized when breast feeding is not possible for either medical and/or social reasons. Furthermore, even in cases where breast feeding is possible, some mothers prefer the convenience afforded by the use of pediatric nutritional products.

In response to the need for pediatric nutritional products soy and milk-based liquid foods have been developed for bottle feeding in conjunction with a rubber or latex nipple. Since the containers for these products should provide a twelve to eighteen month shelf life, a hermetic seal must be provided across the top of the container. A hermetic seal is one which when in place is impervious to microbiological intrusion and external influence. Presently the industry provides a hermetic seal through the use of a glass container, to which is secured by vacuum closure a stamped steel cap having a pre cut rubber, or vinyl plasticol gasket. This vacuum closure of the container is then subjected to temperatures above the ambient air temperature, and more specifically to retort conditions, whereby the hermetic seal must survive sterilization of the nutritional product and the container. Since the glass container and the stamped steel cap expand a similar amount and since a vacuum is present within the container, the hermetic seal is maintained during the sterilization process.

Due to concerns about material cost, container weight, and breakage, suppliers of nutritional products have sought to manufacture the nutritional product container from a plastic substance, such as polypropylene, which is relatively clear, optically and cost effective as compared to glass. The problem arises in attempting to provide a cap for a plastic container which maintains a hermetic seal.

Since it is difficult to maintain a vacuum in a plastic container and conventional metal caps and plastics expand by a dissimilar amount, conventional metal caps can not maintain a hermetic seal for plastic containers when subjected to retort conditions. Furthermore, the application of heat under retort conditions causes polymer relaxation or shrinkage, especially in the upper neck portion of the container. Injection or extrusion molded bottles are formed by stretching the polymer molecules while the heat of sterilization causes those molecules to relax and actually shrinks the diameter of the neck. This shrinkage causes problems in maintaining a conventional metal cap on a plastic bottle. This shrinkage also prevents the use of a conventional plastic cap on a plastic bottle.

One solution to these problems would be to apply a substantial amount of torque when initially capping the bottle, however the amount of torque necessary to maintain a conventional cap in place is so high that a person would not be able to easily twist off the cap following retort. Another possible solution would be to fabricate a bottle from a plastic which does not shrink at retort temperatures and can maintain an internal vacuum without distortion. However, the cost of providing such a bottle is prohibitive.

Another possible approach to the providing of a hermetic seal to a plastic container would be to utilize a barrier membrane, such as aluminum foil, such that the integrity of the seal is independent of the closure. This primary membrane seal would be protected from accidental or premature puncture by an overcap of a conventional design. One type of foil seal is the type which is peelable.

However, in dealing with nutritional products subject to spoilage, peelable seals are not optimal for maintaining confidence that the product has not been tampered with, or for ensuring against spoilage.

A heat fused foil seal, which imparts a permanent seal, is desirable. However, the use of a heat-fused foil membrane necessitates that the outer cap be removed, followed by the piercing of the membrane seal with of a microbial laden device, such as scissors or a fingernail, thereby contaminating the product with bacteria.

It is thus apparent that a need exists for an improved closure for a pre filled, membrane sealed nutritional product container which provides system seal integrity, as well as permitting the opening of the nutritional products container in a single action motion.

DISCLOSURE OF THE INVENTION

There is disclosed a closure for a membrane sealed product container, said closure comprising, a generally cylindrical side wall, said side wall having threads along the inner surface thereof for threadedly engaging the neck of said container, a top, said top having an upper surface, said upper surface having a protective rim extending upwardly therefrom, said top also having a dome assembly, said protective rim extending above said dome assembly, said dome assembly including a dome, said dome having top and bottom surfaces, said bottom surface having at least one downwardly projecting plow member.

There is also disclosed a closure for a membrane sealed container, said closure comprising, a generally cylindrical side wall, and a top, said top having a deformable dome assembly, said dome assembly having top and bottom surfaces, said bottom surface having at least one downwardly projecting plow member, said plow member being oriented in said closure such that upon downward deformation of said dome, said plow member ruptures said membrane seal.

There is also disclosed a closure for a membrane sealed product container, said closure comprising, a generally cylindrical side wall, said side wall having threads along the inner surface thereof for threadedly engaging the neck of said container, and a top having an upper surface, the improvement characterized in that said upper surface has a protective rim extending upwardly therefrom, said top also having a dome assembly located centrally of said protective rim, said protective rim extending above said dome assembly, said dome assembly including a dome and first and second wall sections, said first and second wall sections located between said dome and said cylindrical side wall, said first wall section being thicker than said second wall section, said dome having top and bottom surfaces, said bottom surface having a downwardly projecting plow assembly having cooperating plow members, each plow member having a proximal end portion and a distal end portion, said proximal end portion extending downwardly a greater distance from said bottom surface than said distal end portion, said proximal end portion having a lower most portion thereof which acts as a piercing tip, said dome having a center rib extending across said dome, said center rib passing between said cooperating plow members, said dome having side ribs located between said plow members and said first wall section, said side ribs being perpendicular to said center rib, said dome deformable upon the application of sufficient force such that said piercing tip extends downwardly through the membrane seal of said container to form a vented, pourable hole opening, whereas prior to deformation said piercing tip is located above said membrane seal.

The present invention provides a closure which permits the opening of a membrane-sealed pediatric nutritional product, adult nutritional product or pharmaceutical product container in a single-action motion without contaminating the nutritional or pharmaceutical product. Yet another important aspect of this invention is to provide a pediatric nutritional product container closure which cooperates with a container to ensure a hermetic seal. Still yet another important aspect of the present invention is to provide a removable cap which can be utilized with a plastic container, wherein the closure and container are able to survive retort conditions. Other aspects and advantages of the invention will be apparent from the following description, the accompanying drawings and the appended claims.

BRIEF DESCRIPTION OF THE DRAWINGS

FIG. 2 illustrates a closure for a product container embodying this invention designated generally by the numeral 30, shown in conjunction with a plastic container 32. The container 32 also has secured to its upper portion a tamper evident device 33 which has its opposite ends attached to the closure 30 and container 32.

Figure 1:
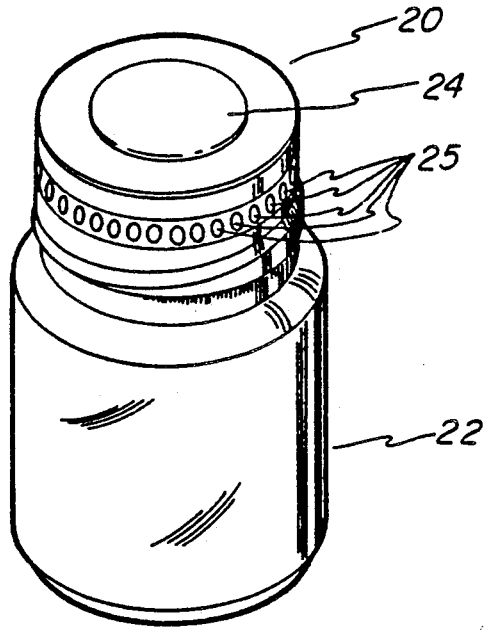
FIG-1 PRIOR ART
FIG. 1 is a perspective view of a prior art glass bottle and a prior art stamped steel metal cap of the type used for pediatric nutritional products.

As can be seen in FIGS. 2 through 5, the closure 30 includes as a basic component thereof, cylindrical side wall 34 having an outer surface 35, as well as an inner surface 36. Outer surface 35 is shown as having three distinct portions, lower smooth portion 37 which serves as the base of the closure, knurled portion 38, and inclined portion 39. Along the inner surface 36 are threads 40 for threadedly engaging the closure 30 to the threaded neck portion 42 of the container 32. The inner surface 36 also features an inner inclined portion 43, inclined substantially parallel to inclined portion 39 and inclined so as to substantially overlap threads 40.

Figure 2:
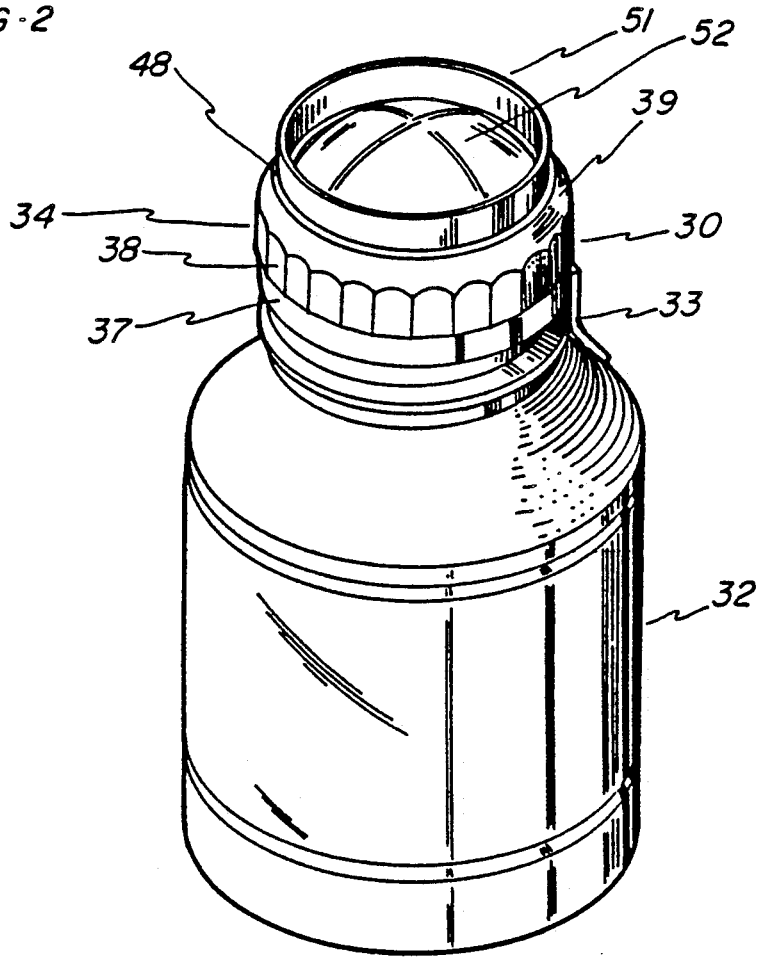
FIG. 2 is a perspective view of the closure in accordance with the present invention shown secured to a plastic container.
Figure 3:
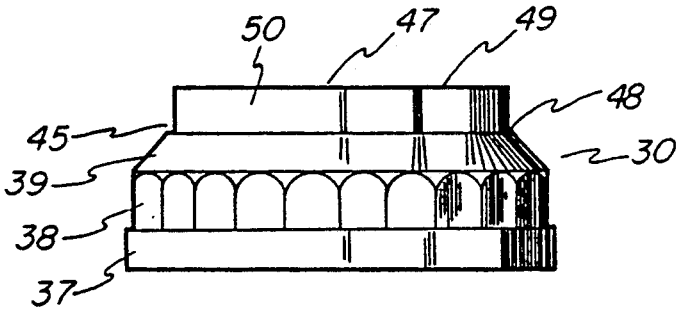
FIG. 3 is a side elevational view of the closure shown in FIG. 2.
Figure 4:
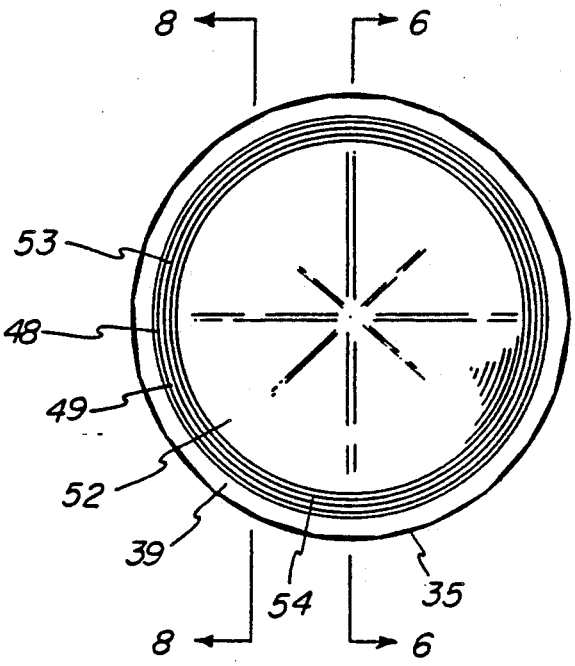
FIG. 4 is a top plan view of the closure.
Figure 5:
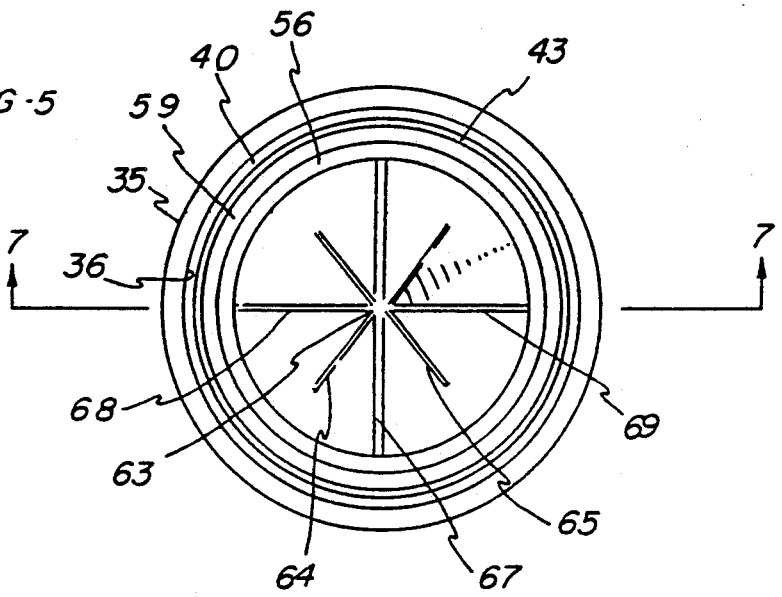
FIG. 5 is a bottom plan view of the closure.

As can be better seen in FIGS. 2, 3 and 4, the closure also includes a top 45 having an upper surface 47. Parts of this upper surface 47 include a lip 48 and a protective rim 49 with its rim wall 50 located centrally of said lip 48.

Figure 6:
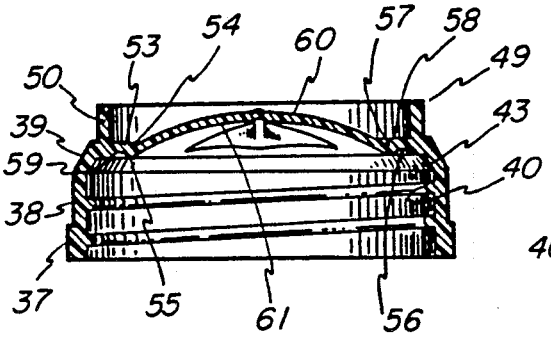
FIG. 6 is a vertical sectional view taken along line 6—6 of FIG. 4.
Figure 7:
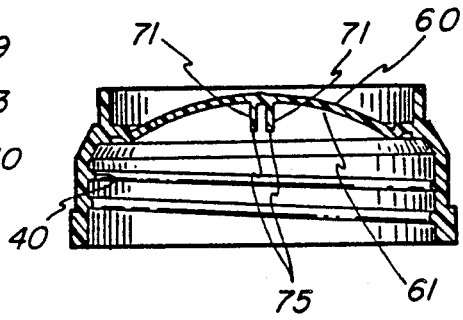
FIG. 7 is a vertical sectional view taken along line 7—7 of FIG. 5.
Figure 8:
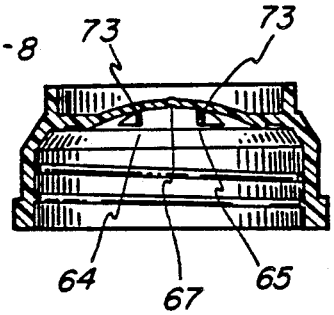
FIG. 8 is a vertical sectional view taken along line 8—8 of FIG. 4.

As can better be seen in FIGS. 6, 7 and 8, the closure also includes a dome assembly 51 having a dome 52, first wall section 53 and second wall section 54. First wall section 53 is relatively thick with respect to second wall section 54. This can be observed by comparing the distance between the lower surface of the second wall section 55 and the lower surface of the first wall section 56 to the upper surface of the second wall section 57 and the upper surface of first wall section 5B. The lower surface of the first wall section 56 is located directly centrally of the rim bottom surface 59.

As can be seen in FIGS. 7 through 10, dome 52 is shown as having a dome top surface 60 as well as a dome bottom surface 61. The arc associated with the dome varies based on the height of the rim wall 50 and the width of the closure. Projecting downwardly from the dome bottom surface 61 is a plow assembly 63 shown in the preferred embodiment as cooperating cross hatched plow members including first plow member 64 and second plow member 65.

A slight indentation in the dome bottom surface 61, such indentation extending across the dome 52 serves as center rib 67. Center rib 67 passes between the cooperating plow members. Side ribs 68 and 69 extend perpendicular to the center rib in the preferred embodiment and are located between each plow member 64 and 65 and the first wall section 53.

Each plow member 64 and 65 has a blade 71 located at the proximal end of the plow member with respect to the center rib 67. The plow members 64 and 65 also have distal ends 73 located close to first wall section 53. The proximal end portion 72 extends downwardly a greater distance from the dome bottom surface 61 than does the distal end portion 73. The lower most portion of the proximal end portion 72 acts as a piercing tip 75.

Figure 10:
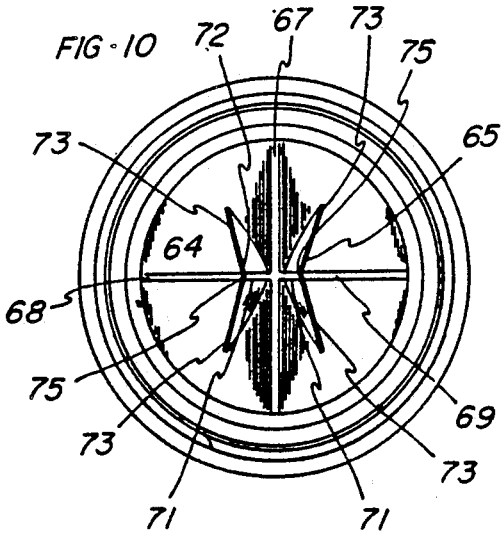
FIG. 10 is a bottom plan view of the closure after deformation has occurred.
Figure 11:
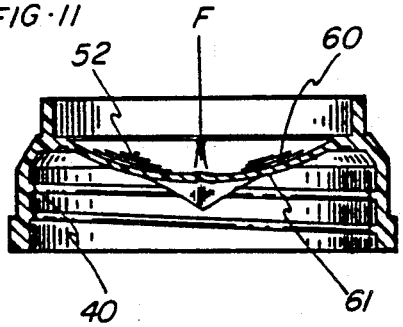
FIG. 11 is a vertical sectional view similar to FIG. 6 but taken along line 10—10 of FIG. 9.
Figure 12:
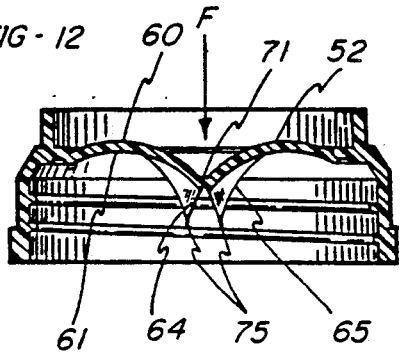
FIG. 12 is a vertical sectional view similar to FIG. 7 but taken along line 12—12 of FIG. 9*a*.
Figure 9A:
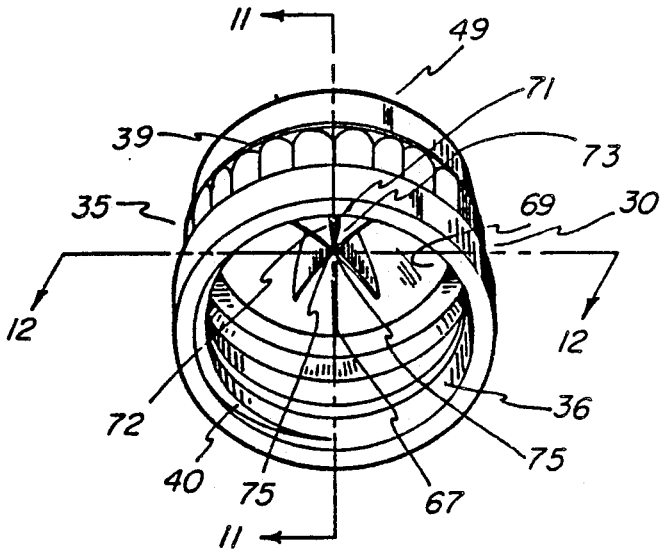
FIGS. 9*a* and 9*b* are perspective views on a greatly enlarged scale showing the closure as it appears prior to deformation of the dome and showing the membrane seal of the container as it appears after deformation of the dome has occurred.
Figure 9B:
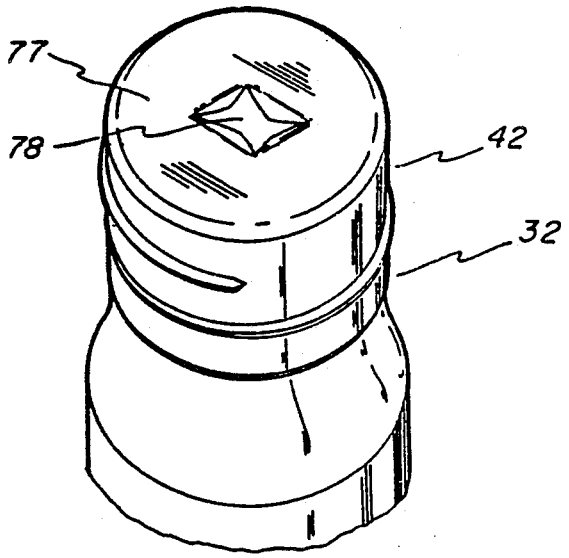

Rim wall 50 extends above dome assembly 51 so as to prevent the accidental deformation of the dome about the pivot point formed by second wall section 54. However, the thickness of the dome assembly is such that it may be deformed upon the application of sufficient force F as shown in FIGS. 11 and 12. FIG. 10 shows the device in the open or deformed configuration. Upon the application of sufficient force F, the center rib 67 assists in the deformation of the dome 52 such that the cooperating plow members engage and extend downwardly through or pierce the membrane seal 77. The pierced seal is shown in FIG. 9*b* as having formed a vented pourable hole therein.

When depressed, while the center rib assists in deforming the dome 52 as shown in FIG. 11, the side ribs 68 and 69 assist in forming the buckled effect on the dome as shown in FIG. 12. Preferably, the inner wall of the container 32 is overlaid by the first wall section 53 such that the second wall section forms a "living hinge" to assist in easier deformation of the dome.

Figure 14:
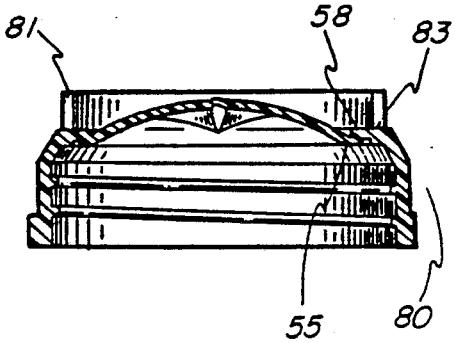
FIG. 14 is a vertical sectional view taken along line 14—14 of FIG. 13. Detailed Description of the Invention Having reference to the drawings, attention is directed first to FIG. 1 which illustrates a prior art closure for a pediatric nutritional product container shown in conjunction with such a container, with the prior art closure being designated by the numeral 20 and the prior art pediatric nutritional container being designated by the numeral 22. The containers of the prior art are fabricated from glass while the prior art closures 20 are fabricated of metal. The closures of the prior art comprise a flat top 24, stamped-steel side walls 25 and a rubber gasket (not shown) positioned between the lip of the neck of the container and the underside of the flat top 24.
Figure 13:
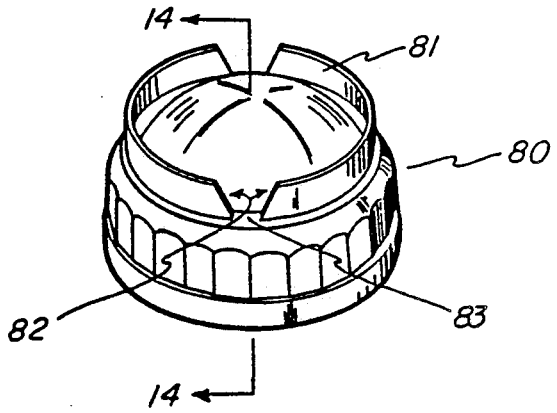
FIG. 13 is a perspective view similar to FIG. 2 but of a modified embodiment of the closure.

FIGS. 13 and 14 disclose a modified closure 8O with a modified rim 81 which permits an area of discontinuity 82 with respect to the modified lip 83. The modified embodiment of the invention is desirable in instances where an individual may not wish to contact the dome 52 with his or her long fingernail for fear of damaging the nail, or where an individual may need to apply additional force against the dome which can best be exerted by placing the flat portion of the thumb completely across the dome assembly.

Since the closure 30 of this invention may be utilized with a heat fused membrane seal 77, whether the laminate is foil or plastic, the plastic cap may be screwed onto the container with as much, or possibly less, torque than currently is used with conventional metal caps, since the microbial hermetic seal is now provided by the membrane seal 77. The maintaining of the membrane seal 77 between the top of the neck of the container 32 and the first wall section 53 precludes any accidental tearing around the heat fused edge of the seal 77.

Best Mode

In actual operation, the closure is deformed and then unscrewed from the container 32. Whereas prior to deformation the piercing tip is located above the membrane seal 77, the deformation provides for a generally hourglass or rectangularly shaped puncture in the membrane seal. The presence of the protective rim 49 prevents accidental opening of the container 32 during shipping by preventing deformation of the dome so as to permit the plows to contact the membrane seal 77, as well as by preventing such contact against a partially deformed dome in the event of hydraulic shock occurring during shipping, which shock would force the membrane seal to rise ever so slightly.

As the seal is broken, the individual opening the container hears an audible sound due to the deformation of the plastic and the rush of air into the container. Furthermore, the hole which is formed is large enough (approximately 15% of the surface area of the membrane seal) to permit the liquid contents of the container to be poured, as well as venting the container.

The closure of this invention may be fabricated from any suitable polymeric material and is preferably fabricated from polypropylene or a polypropylene copolymer. Additionally, the relative thicknesses of the cylinder wall 34 and top 45 may be selected to ensure ease of deformation yet adequate audible confirmation of deformation since if the dome deforms too loudly, questions may be raised as to whether the vacuum seal had already been broken.

Thus, the potential for problems in preserving the hermetic seal and surviving retort conditions is precluded by the present invention. Further, the closure permits the opening of the container in a single action motion, since once the dome is deformed, the cap may be unscrewed from the container without any subsequent opening procedures such as could involve the use of a finger or tool to open the membrane seal.

Industrial Applicability

Annually, approximately 200,000,000 units of pediatric nutritional products are distributed in the U.S. alone, with many of these units currently utilizing glass containers and stamped steel metal caps. The industry has long sought ways to eliminate the glass containers and move to a less expensive cap as well. This invention solves this long felt need.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A closure for a membrane sealed container, said closure comprising, a generally cylindrical side wall, said side wall having threads along the inner surface thereof for threadedly engaging the neck of said container, and a top, said top having an upper surface, said upper surface having a protective rim extending upwardly therefrom, said top also having a dome assembly, said protective rim extending above said dome assembly, said dome assembly including a dome, said dome having top and bottom surfaces, said bottom surface having (at least downwardly projecting plow member) projecting therefrom a plow assembly, said plow assembly having cooperating plow members, said dome having a center rib extending across said dome, said center rib passing between said cooperating plow members.

2. The closure as claimed in claim 1 wherein each of said plow members has a proximal end portion and a distal end portion, said proximal end portion extending downwardly a greater distance from said bottom surface than said distal end portion.

3. The closure as claimed in claim 2 wherein said proximal end portion has a lower most portion thereof which acts as a piercing tip.

4. The closure as in claimed in claim 1 wherein said dome assembly has first and second wall sections located between said dome and said cylindrical side wall, said first and second wall sections being of different thicknesses.

5. The closure as claimed in claim 1 wherein said dome assembly has first and second wall sections located between said dome and said cylindrical side wall.

6. The closure as claimed in claim 5 wherein said first wall section is thicker than said second wall section.

7. The closure as claimed in claim 6 wherein said dome has side ribs located between said plow members and said first wall section.

8. The closure as claimed in claim 7 wherein said side ribs are perpendicular to said center rib.

9. The closure as claimed in claim 8 wherein said dome is located centrally of said protective rim.

10. The closure as claimed in claim 9 wherein said protective rim is annular.

11. The closure as claimed in claim 9 wherein said rim has at least one area of discontinuity there along.

12. The closure as claimed in claim 3 wherein said dome is deformable upon the application of sufficient force such that said piercing tip extends downwardly through the membrane seal of said container, whereas prior to deformation said piercing tip is located above said membrane seal.

13. The closure as claimed in claim 12 wherein said plow ruptures said membrane seal so as to form a vented, pourable hole therein.

14. A closure for a membrane sealed pediatric nutritional product container, said closure comprising, a generally cylindrical side wall, said side wall having threads along the inner surface thereof for threadedly engaging the neck of said container, and a top having an upper surface, the improvement characterized in that said upper surface has a protective rim extending upwardly therefrom, said top also having a dome assembly located centrally of said protective rim, said protective rim extending above said dome assembly, said dome assembly including a dome and first and second wall sections, said first and second wall sections located between said dome and said cylindrical side wall, said first wall section being thicker than said second wall section, said dome having top and bottom surfaces, said bottom surface having a downwardly projecting plow assembly having cooperating plow-members, each plow member having a proximal end portion and a distal end portion, said proximal end portion extending downwardly a greater distance from said bottom surface than said distal end portion, said proximal end portion having a lower most portion thereof which acts as a piercing tip, said dome having a center rib extending across said dome, said center rib passing between said cooperating plow members, said dome having side ribs located between said plow members and said first wall section, said ribs being perpendicular to said center rib, said dome deformable upon the application of sufficient force such that said piercing tip extends downwardly through the membrane seal of said container to form a vented, pourable hole therein, whereas prior to deformation said piercing tip is located above said membrane seal.

15. A closure for a membrane sealed pediatric nutrition container, said closure comprising, a generally cylindrical side wall, and a top, said top having a deformable dome assembly, said dome assembly having top and bottom surfaces, said bottom surface having at least one downwardly projecting plow member, said dome having a center rib extending across said dome, said center rib passing adjacent said downwardly projecting plow member, said plow member being oriented in said closure such that upon deformation of said dome said plow member ruptures said membrane seal and thus opens said container.

16. The closure as claimed in claim 15 wherein said bottom surface has projecting therefrom a plow assembly, said plow assembly having cooperating plow members.

17. The closure as claimed in claim 15 wherein said dome assembly has first and second wall sections located between said dome and said cylindrical side wall.

18. The closure as claimed in claim 17 wherein said first wall section is thicker than second said wall section.

19. The closure as claimed in claim 17 wherein said dome has a side rib located between said downwardly projecting plow member and said first wall section.

20. The closure as claimed in claim 19 wherein said side rib is perpendicular to said center rib.

* * * * *